US011649825B2

(12) United States Patent
Maroccia

(10) Patent No.: US 11,649,825 B2
(45) Date of Patent: May 16, 2023

(54) MULTISTAGE CENTRIFUGAL PUMP FOR CONVEYING A FLUID

(71) Applicant: Sulzer Management AG, Winterthur (CH)

(72) Inventor: Bruno Maroccia, Winterthur (CH)

(73) Assignee: SULZER MANAGEMENT AG, Winterthur (CH)

( * ) Notice: Subject to any disclaimer, the term of this patent is extended or adjusted under 35 U.S.C. 154(b) by 25 days.

(21) Appl. No.: 17/242,592

(22) Filed: Apr. 28, 2021

(65) Prior Publication Data

US 2021/0363995 A1 Nov. 25, 2021

(30) Foreign Application Priority Data

May 20, 2020 (EP) ..... 20175833

(51) Int. Cl.

| | |
|---|---|
| ***F04D 1/06*** | (2006.01) |
| ***F04D 1/00*** | (2006.01) |
| ***F04D 1/08*** | (2006.01) |
| ***F04D 29/42*** | (2006.01) |

(52) U.S. Cl.
CPC ..... *F04D 1/006* (2013.01); *F04D 1/08* (2013.01); *F04D 29/426* (2013.01)

(58) Field of Classification Search
CPC ..... F04D 1/006; F04D 1/08
See application file for complete search history.

(56) References Cited

U.S. PATENT DOCUMENTS 2,219,098 A * 10/1940 Dorer ..... F04D 1/063 415/198.1

FOREIGN PATENT DOCUMENTS

| | | | |
|---|---|---|---|
| CN | 203532269 U | * | 4/2014 |
| CN | 206035832 U | * | 3/2017 |
| CN | 106762854 A | | 5/2017 |
| CN | 109372757 A | | 2/2019 |
| CN | 208950881 U | * | 6/2019 |
| DE | 897048 C | | 11/1953 |
| DE | 1032100 B | | 6/1958 |
| GB | 191201639 A | | 1/1913 |

OTHER PUBLICATIONS

Extended European Search Report dated Nov. 4, 2020 in corresponding European Patent Application No. 20175833.1, filed May 20, 2020.

* cited by examiner

*Primary Examiner* — Kayla McCaffrey
(74) *Attorney, Agent, or Firm* — Global IP Counselors, LLP

(57) ABSTRACT

A multistage centrifugal pump for conveying a fluid includes a pump housing, two first stage impellers, a last stage impeller and a shaft. The two first stage impellers and the last stage impeller convey the fluid from a housing inlet to a housing outlet. The shaft rotates each impeller about an axial direction, each impeller comprising a suction side to receive the fluid and a discharge side to discharge the fluid. The last stage impeller is a double suction impeller, having a first suction side and a second suction side, and the last stage impeller is arranged between the two first stage impellers with respect to the axial direction. Each impeller of the two first stage impellers is arranged with the suction side of a respective first stage impeller facing one of the first and second suction sides of the last stage impeller.

12 Claims, 3 Drawing Sheets

MULTISTAGE CENTRIFUGAL PUMP FOR CONVEYING A FLUID

CROSS-REFERENCE TO RELATED APPLICATION

This application claims priority to European Patent Application No. 20175833.1, filed May 20, 2020, the contents of which are hereby incorporated herein by reference in their entirety.

BACKGROUND

Field of the Invention

The invention relates to a multistage centrifugal pump for conveying a fluid.

Background Information

Conventional centrifugal pumps for conveying a fluid, for example a liquid such as water, are used in many different industries. Examples are the oil and gas industry, the power generation industry, the chemical industry, the water industry or the pulp and paper industry. Multistage centrifugal pumps have at least two impellers and a shaft for rotating the impellers. The impellers can be configured for example as radial impellers or as axial or semi-axial impellers or as helicoaxial impellers. Furthermore, the impellers can be configured as open impellers or as a closed impellers, where a shroud is disposed on the impeller, the shroud at least partially covering the vanes of the impeller, or as a semi-open impeller. Furthermore, it is known to configure an impeller as a single suction impeller or as a double suction impeller. In the case of a single suction impeller the fluid approaches the impeller only from one side, i.e. the impeller has only one suction side. In the case of a double suction impeller the fluid approaches the impeller from both sides, i.e. the impeller has two suction sides. It is also known to design centrifugal pumps with a combination of single suction impeller(s) and double suction impellers.

SUMMARY

In a multistage centrifugal pump a plurality of impellers is mounted to the shaft in a torque proof manner, with the impellers being arranged in series on the shaft.

Many multistage centrifugal pumps includes at least one balancing arrangement for at least partially balancing the axial thrust that is generated by the impellers during operation of the pump. The balancing arrangement reduces the total axial thrust generated by the rotating impellers (hydraulic forces) and acting on the axial bearing or the thrust bearing. The residual thrust needs to be absorbed by the bearing, whose size, weight and cost is proportional to the magnitude of said residual thrust, hence there is a need of reducing the residual thrust as much as possible. Besides this, high forces are associated with higher mechanical losses that ultimately reduce the efficiency of the pump.

It has been found that the axial thrust can be balanced to a good extent by a proper disposition of the impellers, for example by an back-to-back arrangement, whereby the thrust generated by one impeller is at least partially compensated by an equivalent but opposite force acting on another impeller fitted symmetrically on the shaft.

More generally, a multistage pump can comprise a first set of impellers and a second set of impellers, wherein the first set of impellers and the second set of impellers are arranged in a back-to-back arrangement, so that the axial thrust generated by the first set of impellers is directed opposite to the axial thrust generated by the second set of impellers. Of course, it is also possible that the first set of impellers and/or the second set of impellers comprises only one impeller.

However, in some embodiments the back-to-back arrangement is not completely effective because, as an example, the total number of stages is odd and all impellers are configured as single suction impellers or because the total number of stages is even but one of the impellers is configured as a double suction impeller and all other impellers are configured as single suction impellers double suction first stage impeller is used. In addition, there are other reasons, why the back-to-back arrangement does not fully balance the axial thrust or why the back-to-back arrangement might not be appropriate. These reasons include for example manufacturing complications associated with an back-to-back arrangement.

It has been found that impellers can be arranged such that the axial thrust is balanced (at least approximately) independent from the number of stages in a fully symmetric layout. The basic idea behind this design is to 'split' the total inflow into two distinct and equal streams, each of which feeds a different set of impellers, e.g. the first stream is guided to the first set of impellers and the second stream is guided to the second set of impellers. After each stream has passed the respective set of impellers, the two streams merge in the last stage of the pump, wherein the last stage comprises a double suction impeller.

FIG. 1 is a schematic representation illustrating a conventional multistage centrifugal pump 1' having a symmetric layout. The multistage centrifugal pump 1' has a pump housing 2' with a first inlet 31' and a second inlet 32' as well as an outlet 4' for the fluid to be conveyed. The pump 1' has a shaft 7' defining an axial direction A'. On the shaft 7' there are mounted two first stage impellers 5' and a last stage impeller 6', which is arranged between the two first stage impellers 5'. Each impeller 5',6' comprises a suction side S' for receiving the fluid and a discharge side D' for discharging the fluid. The two first stage impellers 5' are configured as single suction impellers, i.e. each first stage impeller 5' has only one suction side. The last stage impeller 6' is configured as a double suction impeller 6' having a first suction side S1' and a second suction side S2'. Upstream of the pump housing 2' the inflow I' is split into two distinct and equal streams, namely a first stream I1' and a second stream I2'.

The first stream I1' is guided to the first inlet 31' and the second stream 12' is guided to the second inlet 32'. The first inlet 31' is in fluid communication with the suction side S' of one of the first stage impellers 5' by a first suction line 81' and the second inlet 32' is in fluid communication with the suction side S' of the other first stage impellers 5' by a second suction line 82'. After the first stream I1' has passed the first stage impeller 5' it is guided to the first suction side S1' of the last stage impeller 6'. After the second stream 12' has passed the first stage impeller 5' it is guided to the second suction side S2' of the last stage impeller 6'. At the last stage impeller 6' the first stream I1' and the second stream 12' are reunited with each other and after having passed the last stage impeller 6' discharged through the outlet 4' as indicated by the arrow O'.

This fully symmetric design results—at least approximately—to a complete balancing of the axial thrust so that the residual thrust equals zero.

Although this symmetric design has proved its worth in practice, it has been found that the design has some drawbacks. The design requires two inlets 31',32' at the pump housing 2', which is more complex and requires more efforts during manufacturing. Furthermore, the design requires a Y-junction, i.e. an additional part for connecting the pump 1' to a pipework. This makes the pump more expensive, heavier and might increase the susceptibility to trouble. In addition, the higher the number of stages of the pump 1' is, the longer the distance between the first inlet 31' and the second inlet 32' becomes. Thus, also the required Y-junction increases, which can cause trouble, for example mechanical problems such as vibrations, increased weight and the like.

Starting from this state of the art, it is therefore an object of the invention to propose a multistage centrifugal pump for conveying a fluid, providing at least a partial balancing of the axial thrust and avoiding the drawbacks of prior art embodiments.

The subject matter of the invention satisfying this object is characterized by the features of the embodiments described herein.

Thus, according to an embodiment of the invention, a multistage centrifugal pump for conveying a fluid is proposed, comprising a pump housing with an inlet and an outlet for the fluid, two first stage impellers and a last stage impeller for conveying the fluid from the inlet to the outlet, and a shaft for rotating each impeller about an axial direction, wherein each impeller comprises a suction side for receiving the fluid and a discharge side for discharging the fluid, wherein the last stage impeller is configured as a double suction impeller, having a first suction side and a second suction side, wherein the last stage impeller is arranged between the two first stage impellers with respect to the axial direction, and wherein each first stage impeller is arranged with the suction side of the first stage impeller facing one of the first and the second suction side of the last stage impeller.

The configuration according to an embodiment of the invention enables a fully symmetric design of the hydraulics of the multistage pump, thus providing a balancing of the axial thrust generated by the rotating impellers. However only one inlet is required and there is no need for a Y-junction outside of the pump housing. The fluid entering the pump through the inlet is divided only inside the pump housing, e.g. by the configuration of the inlet housing, into a first stream and a second stream, wherein the first stream is guided to the suction side of one of the first stage impellers and the second stream is guided to the suction side of the other first stage impeller. The two first stage impellers are arranged in a face-to-face arrangement, i.e. the impeller eye at the suction side of the one first stage impeller faces the impeller eye at the suction side of the other first stage impeller.

Since there is only one inlet at the pump housing, the pump can be integrated much more easily into pipework without requiring any specific piping such as a Y-junction. This also reduces the required material and the weight of the pump, so that the multistage pump is less expensive. In addition, the effort for installing the pump is considerably reduced.

Furthermore, the unit comprising the inlet, the two first stage impellers and the last stage impeller may be easily extended to a multiphase pump having more than two stages without larger modifications to said unit. The inlet of the pump together with the two first stage impellers and the last stage impeller may basically remain the same independent from the total number of stages of the multistage pump.

Preferably the suction side of each first stage impeller is in fluid communication with the inlet by means of a suction line, with each suction line arranged within the pump housing. Each suction line can be configured as a channel, for example as a channel delimited by the pump housing, wherein the channel guides the fluid entering through the inlet to the suction side of one of the first stage impellers.

According to a first preferred embodiment the multistage centrifugal pump has exactly three impellers, namely the two first stage impellers and the last stage impeller, wherein the two first stage impellers are configured as single suction impellers.

Furthermore, it is preferred that the multistage centrifugal pump comprises two crossover lines, each of which connects the discharge side of one of the first stage impellers with one of the first and the second suction side of the last stage impeller.

According to a second preferred embodiment the centrifugal pump in accordance with the invention comprises a first set of impellers and a second set of impellers, wherein each set of impellers comprises one of the first stage impellers, and wherein the first set of impellers and/or the second set of impellers comprises at least one intermediate stage impeller. With such a configuration the multistage pump can be designed with three or more stages.

Preferably each of the first set and the second set of impellers comprises an intermediate stage impeller.

Furthermore, it is preferred that the first set of impellers and the second set of impellers are configured in a back-to-back arrangement, to at least partially balance the axial thrust generated by the first set of impellers and the second set of impellers, respectively.

In particular for embodiments, in which the residual axial thrust shall be minimized, the first set of impellers and the second set of impellers comprise the same number of impellers.

Also for those embodiment having more than two stages it is preferred that the pump comprises two crossover lines, each of which connects the discharge side of one of the intermediate stage impellers with one of the first and the second suction side of the last stage impeller.

In some embodiments at least one crossover line is configured as an external line arranged outside the pump housing.

It is also possible that each crossover line is configured as an external line arranged outside the pump housing.

Preferably the multistage centrifugal pump is configured as a between-bearing pump.

Further advantageous measures and embodiments of the invention will become apparent from the dependent claims.

BREIF DESCRIPTION OF THE DRAWINGS

The invention will be explained in more detail hereinafter with reference to the drawings.

DETAILED DESCRIPTION

Figure 1:
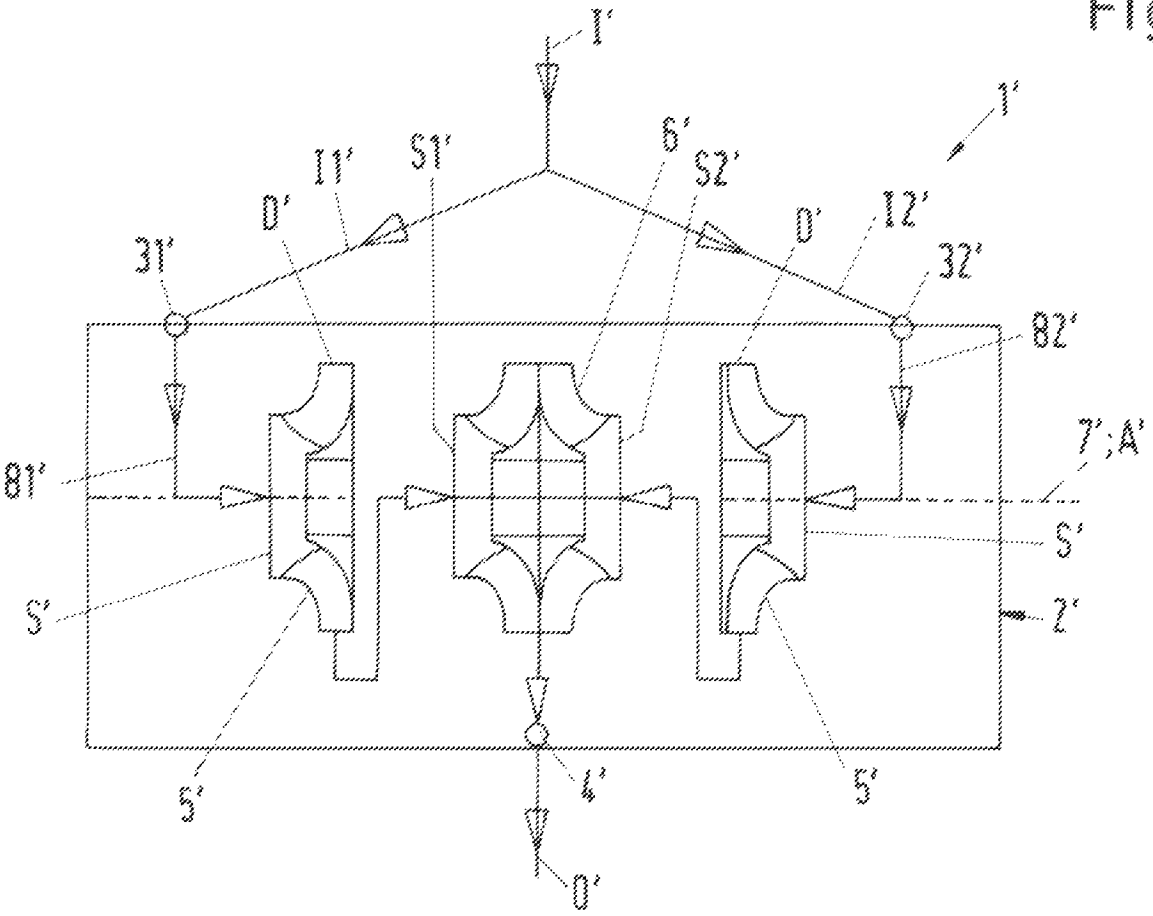
FIG. 1 is a multistage centrifugal pump according to the prior art.

FIG. 1 shows a schematic representation of a multistage centrifugal pump 1' according to the prior art and configured as a two stage centrifugal pump 1'. Since FIG. 1 has already been explained hereinbefore in the description of the prior art no further explanations are necessary. In order to differentiate the prior art arrangement over the embodiments according to the invention, the components of the pump 1' representing prior art are designated in FIG. 1 with reference numerals having a prime (inverted comma) behind the respective reference numeral.

Figure 2:
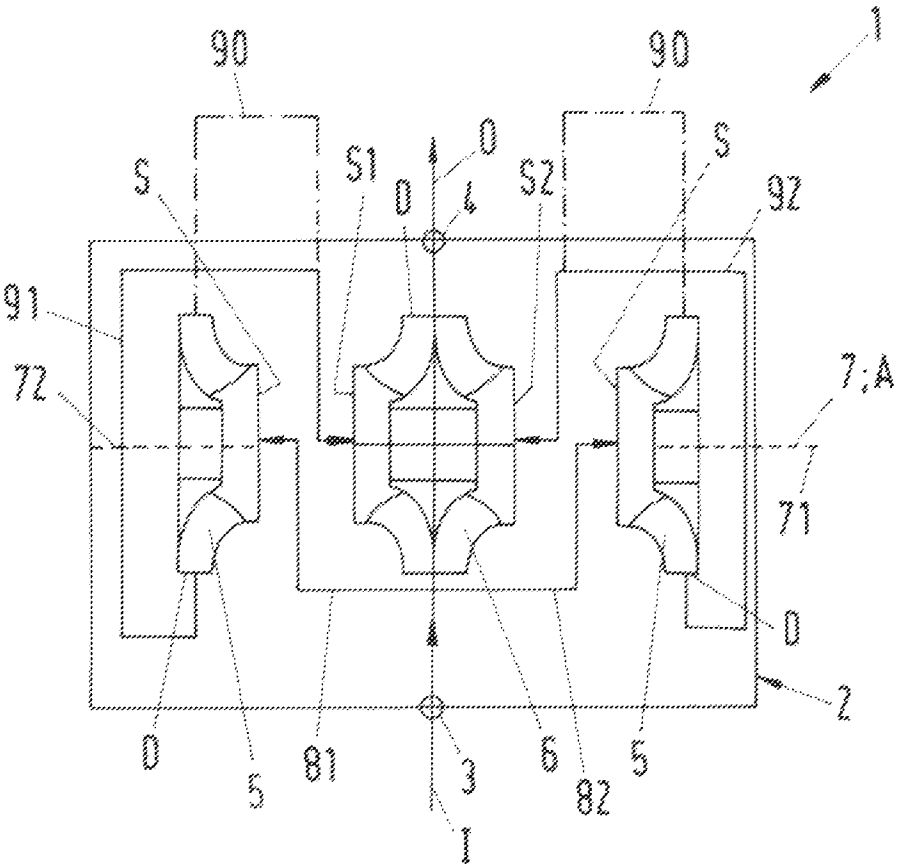
FIG. 2 is a first embodiment of a multistage centrifugal pump according to the invention.

FIG. 2 shows a schematic representation of a first embodiment of a multistage centrifugal pump according to the invention, which is designated in its entity with reference numeral 1. The pump 1 is designed as a centrifugal pump for conveying a fluid, for example a liquid such as water.

The multistage centrifugal pump 1 comprises a pump housing 2 having an inlet 3 and an outlet 4 for the fluid to be conveyed. The centrifugal pump 1 further comprises two first stage impellers 5 and a last stage impeller 6 interposed between the two first stage impellers 5, as well as a shaft 7 for rotating each impeller 5, 6 about an axial direction A. The axial direction A is defined by the axis of the shaft 7. Each impeller 5, 6 is mounted to the shaft 7 in a torque proof manner. The shaft 7 has a drive end 71, which can be connected to a drive unit (not shown) for driving the rotation of the shaft 7 about the axial direction A. The drive unit can comprise, for example, an electric motor. The other end of the shaft 7 is referred to as non-drive end 72.

Each of the first stage impellers 5 is in fluid communication with the inlet 3. A first suction line 81 constitutes the fluid communication between the inlet 3 and the first stage impeller 5 on the left side in FIG. 2, and a second suction line 82 constitutes the fluid communication between the inlet 3 and the first stage impeller on the right sight of FIG. 2. Each suction line 81, 82 can be configured as a channel which is delimited by the pump housing 2 or an inlet housing (not shown) that is part of the pump housing 2. The inflow I of the fluid to be conveyed enters the pump housing 2 through the inlet 3 and is then divided in a first stream passing through the first suction line 81 and a second stream passing through the second suction line 82.

The first stage impellers 5 are each configured as single suction impellers 5, i.e. as impellers 5 having only one suction side S. The suction side S of the impeller 5 is the side where the eye of the impeller 5 is arranged, i.e. the side, from which the fluid approaches the impeller 5. Each impeller has a discharge side D, i.e. the side where the fluid is discharged from the impeller 5. Regarding the first stage impellers 5 a volute or a diffusor may be arranged at the discharge side D.

The last stage impeller 6 is configured as a double suction impeller 6, i.e. the fluid approaches the impeller 6 from both sides regarding the axial direction A. Thus the last stage impeller 6 has a first suction side S1 on the left side in FIG. 2 and a second suction side S2 at the right side in FIG. 2. The last stage impeller 6 has a discharge side D which is in fluid communication with the outlet 4 of the pump. The outflow of the fluid discharged through the outlet 4 is indicated by the arrow O in FIG. 2.

The first embodiment of the multistage centrifugal pump 1 is configured as a two stage centrifugal pump 1 with the two first stage impellers 5 and the last stage impeller 6 constituting the second stage impeller 6.

The two first stage impellers 5 are arranged with the suction side S of the respective first stage impeller 5 facing one of the first S1 and second suction side S2 of the last stage impeller 6. The first stage impeller 5 on the left side of FIG. 2 is arranged such that its suction side S faces the first suction side S1 of the last stage impeller 6. The first stage impeller 5 on the right side of FIG. 2 is arranged such that its suction side S faces the second suction side S2 of the last stage impeller 6. Thus, the two suction sides S of the first stage impellers 5 are facing each other. Therefore, the axial thrust generated by one of the first stage impellers 5 compensates the axial thrust generated by the other one of the first stage impellers 5. The residual thrust generated by the two first stage impellers 5 is at least approximately zero.

Since the last stage impeller 6 is configured as a double suction impeller 6 with the first suction side S1 and the second suction side S2, the residual axial thrust generated by the last stage impeller 6 is at least approximately zero.

For guiding the first stream from the discharge side D of the first stage impeller 5 to the first suction side S1 a first crossover line 91 is disposed between the discharge side D of the first stage impeller 5 and the first suction side S1 of the last stage impeller 6. For guiding the second stream from the discharge side D of the first stage impeller 5 to the second suction side S2 a second crossover line 92 is disposed between the discharge side D of the first stage impeller 5 and the second suction side S1 of the last stage impeller 6. Each crossover line 91, 92 may include a diffuser.

It has to be noted that each of the crossover lines 91, 92 can be configured as an internal line completely arranged inside the pump housing 2 or as an external line arranged at least partially outside the pump housing 2 as it is indicated by the dash dotted lines 90 in FIG. 2.

The centrifugal pump 1 comprises bearings (not shown) on both ends of the shaft 7, namely at or near the non-drive end 72 of the shaft, and near the drive end 71 of the shaft 7, i.e. the centrifugal pump 1 is designed as a between-bearing pump.

During operation of the multistage pump 1 the inflow I of the fluid enters the pump housing 2 through the inlet 3 and is then divided into the first stream passing through the first suction line 81 to the suction side S of the left first stage impeller 5 (according to the representation in FIG. 2) and the second stream passing through the second suction line 82 to the suction side S of the right first stage impeller 5 (according to the representation in FIG. 2).

The first stream is discharged at the discharge side of the first stage impeller 5 in the first crossover line 91 and guided to the first suction side S1 of the last stage impeller 6. The second stream is discharged at the discharge side D of the first stage impeller 5 in the second crossover line 92 and guided to the second suction side S2 of the last stage impeller 6. At the last stage impeller 6 the first stream and the second stream are reunited with each other and leave the pump 1 through the outlet 4 as outflow O.

Figure 3:
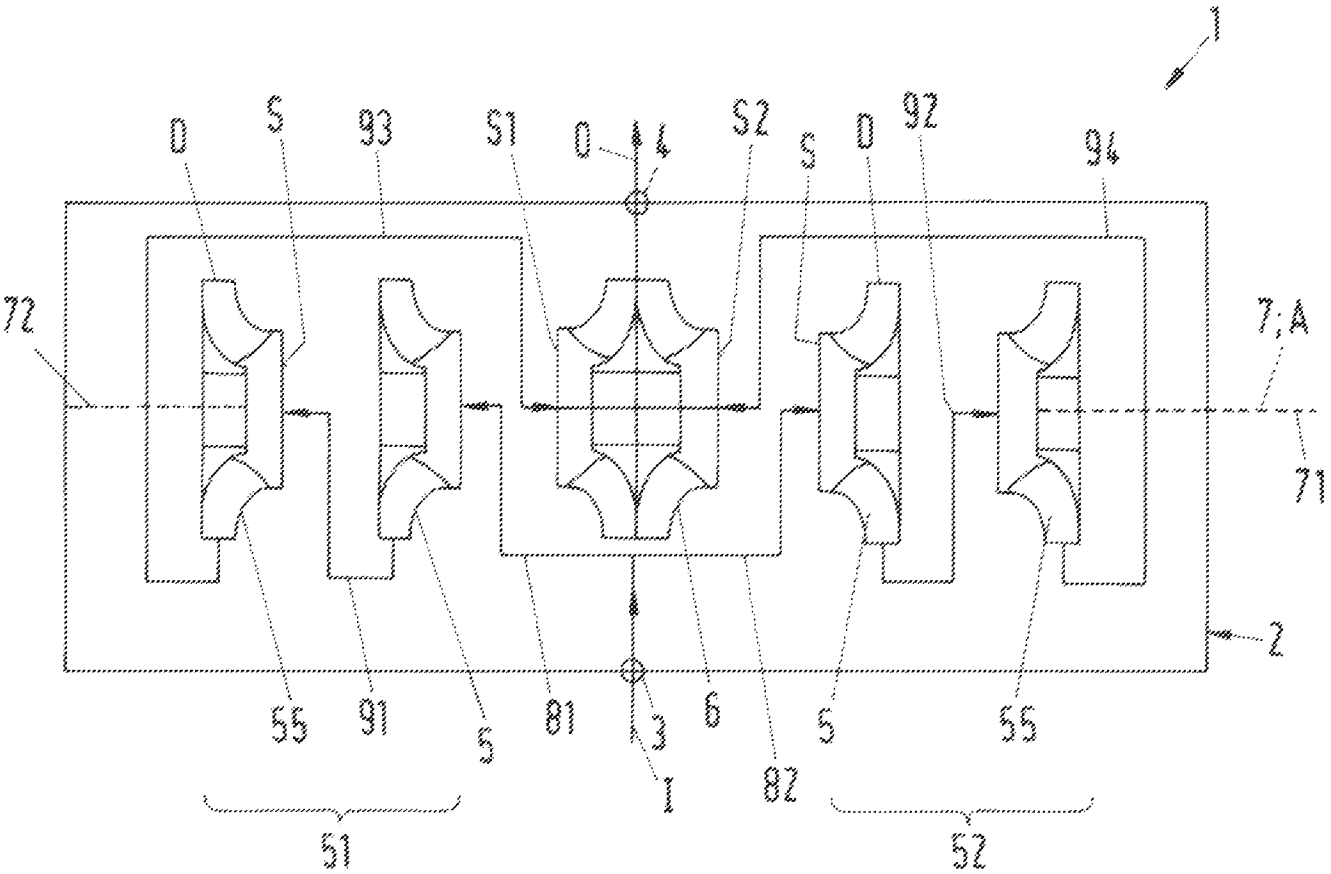
FIG. 3 is a second embodiment of a multistage centrifugal pump according to the invention.

FIG. 3 shows a schematic representation of a second embodiment of a multistage centrifugal pump 1 according to an embodiment of the invention. In the following description of the second embodiment of the multistage centrifugal pump 1 only the differences from the first embodiment are explained in more detail. The explanations with respect to the first embodiment are also valid in the same way or in analogously the same way for the second embodiment. Same reference numerals designate the same features that have been explained with reference to the first embodiment or functionally equivalent features.

The second embodiment is configured as a multistage pump 1 having more than two stages. Here the multistage pump 1 is configured as a three stage centrifugal pump. It has to be noted that the number of three stages is only exemplary. In other embodiments, the multistage pump 1 may comprise more than three stages.

Furthermore, it has to be noted that the module comprising the inlet 3, the two first stage impellers 5 and the last stage impeller 6 is essentially the same as in the first embodiment. It is an important advantage that said module may be configured essentially in the same manner independent from the total number of stages of the centrifugal pump 1.

According to the second embodiment the multistage centrifugal pump 1 comprises a first set of impellers 51 and a second set of impellers 52, wherein each set of impellers 51, 52 comprises one of the first stage impellers 5. In addition, each set of impellers 51, 52 comprises at least one intermediate stage impeller 55.

In other embodiments only the first set of impellers 51 or only the second set of impellers 52 comprises at least one intermediate stage impeller 55.

In the second embodiment each of the first set and the second set of impellers 51, 52 comprises exactly one intermediate stage impeller 55.

In other embodiments each of the first set and the second set of impellers 51, 52 comprises more than one intermediate impeller 55.

Preferably and as it is shown in FIG. 3 the first set of impellers 51 and the second set of impellers 52 are configured in a back-to-back arrangement.

In the second embodiment the first set of impellers 51 and the second set of impellers 52 comprise the same number of impellers 5, 55.

In other embodiments, the first set of impellers 51 and the second set of impellers 52 comprise different numbers of impellers 5, 55.

Each intermediate stage impeller 55 is arranged downstream of one of the first stage impellers 5 and upstream of the last stage impeller 6.

In the second embodiment the first crossover line 91 connects the discharge side D of the left first stage impeller 5 (according to the representation in FIG. 3) with the intermediate stage impeller 55 of the first set 51 of impellers. The second crossover line 92 connects the discharge side D of the right first stage impeller 5 (according to the representation in FIG. 3) with the intermediate stage impeller 55 of the second set of impellers 52.

A third crossover line 93 is configured to connect the discharge side D of the intermediate stage impeller 55 of the first set of impellers 51 with the first suction side S1 of the last stage impeller 6. In addition, a fourth crossover line 94 is configured to connect the discharge side D of the intermediate stage impeller 55 of the second set of impellers 52 with the second suction side S2 of the last stage impeller 6.

During operation of the multistage pump 1 the inflow I of the fluid enters the pump housing 2 through the inlet 3 and is then divided into the first stream passing through the first suction line 81 to the suction side S of the left first stage impeller 5 (according to the representation in FIG. 3) and the second stream passing through the second suction line 82 to the suction side S of the right first stage impeller 5 (according to the representation in FIG. 3). The first stream is discharged at the discharge side D of the first stage impeller 5 in the first crossover line 91 and guided to the suction side S of the intermediate stage impeller 55 of the first set of impellers 51. After having passed this intermediate stage impeller 55, the first stream is guided by the third crossover line 93 to the first suction side S1 of the last stage impeller 6. The second stream is discharged at the discharge side D of the first stage impeller 5 in the second crossover line 92 and guided to the suction side S of the intermediate stage impeller 55 of the second set of impellers 52. After having passed this intermediate stage impeller 55, the second stream is guided by the fourth crossover line 94 to the second suction side S2 of the last stage impeller 6. At the last stage impeller 6 the first stream and the second stream are reunited with each other and leave the pump 1 through the outlet 4 as outflow O.

The skilled person will easily understand how this configuration can be expanded to more than three stages.

What is claimed:

1. A multistage centrifugal pump for conveying a fluid, comprising:

a pump housing with an inlet and an outlet for the fluid;

two first stage impellers and a last stage impeller configured to convey the fluid from the inlet to the outlet, the first stage impellers each configured as single suction impellers; and a shaft configured to rotate each impeller about an axial direction, each impeller comprising a suction side to receive the fluid and a discharge side to discharge the fluid, the last stage impeller configured as a double suction impeller, having a first suction side and a second suction side, and the last stage impeller arranged between the two first stage impellers with respect to the axial direction, each impeller of the two first stage impellers arranged with the suction side of a respective first stage impeller facing one of the first and the second suction sides of the last stage impeller.

2. The multistage centrifugal pump in accordance with claim 1, wherein the suction side of each impeller of the first stage impellers is in fluid communication with the inlet by a suction line, with each suction line arranged within the pump housing.

3. The multistage centrifugal pump in accordance with claim 1, wherein the two first stage impellers and the last stage impeller are the only three impellers.

4. The multistage centrifugal pump in accordance with claim 1, further comprising two crossover lines, each of the two crossover lines connecting the discharge side of one of the first stage impellers with one of the first and the second suction sides of the last stage impeller.

5. The multistage centrifugal pump in accordance with claim 1, further comprising a first set of impellers and a second set of impellers, wherein each set of the first and second sets of impellers comprises one of the first stage impellers, and the first set of impellers or the second set of impellers comprises at least one intermediate stage impeller.

6. The multistage centrifugal pump in accordance with claim 5, wherein each of the first set of impellers and the second set of impellers comprises an intermediate stage impeller.

7. The multistage pump in accordance with claim 6, further comprising two crossover lines, each of the two cross over lines connecting the discharge side of one of the intermediate stage impellers with one of the first and the second suction sides of the last stage impeller.

8. The multistage centrifugal pump in accordance with claim 7, wherein at least one crossover line of the two crossover lines is configured as an external line arranged outside the pump housing.

9. The multistage centrifugal pump in accordance with claim 7, wherein each crossover line of the two crossover lines is configured as an external line arranged outside the pump housing.

10. The multistage centrifugal pump in accordance with claim 5, wherein the first set of impellers and the second set of impellers are configured in a back-to-back arrangement.

11. The multistage centrifugal pump in accordance with claim 5, wherein the first set of impellers and the second set of impellers comprise the same number of impellers.

12. The multistage centrifugal pump in accordance with claim 1, wherein the multistage centrifugal pump is a between-bearing pump.

* * * * *